US006260471B1

(12) United States Patent
Tanaka et al.

(10) Patent No.: US 6,260,471 B1
(45) Date of Patent: Jul. 17, 2001

(54) FUEL FEED PUMP

(75) Inventors: Katsunori Tanaka; Wakaki Miyaji, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/481,706

(22) Filed: Jan. 12, 2000

(30) Foreign Application Priority Data

Aug. 6, 1999 (JP) ..... 11-223759

(51) Int. Cl.[7] ..... F02M 59/10
(52) U.S. Cl. ..... 92/169.1; 92/248
(58) Field of Search ..... 92/169.1, 248

(56) References Cited

U.S. PATENT DOCUMENTS 4,625,572 * 12/1986 Yamashita ..... 92/170 X
4,741,254 * 5/1988 Taylor ..... 92/248
5,094,150 * 3/1992 Russner et al. ..... 92/248
5,435,234 * 7/1995 Bentz et al. ..... 92/248
6,113,304 * 9/2000 Tremoulet, Jr. et al. ..... 403/301
6,171,070 * 1/2001 Mitake ..... 417/273

FOREIGN PATENT DOCUMENTS 10-82354 3/1998 (JP) .
10-122157 12/1998 (JP) .

* cited by examiner

*Primary Examiner*—John E. Ryznic
(74) *Attorney, Agent, or Firm*—Sughrue, Mion, Zinn, Macpeak & Seas, PLLC

(57) ABSTRACT

A fuel feed pump in which the number of steps for machining a piston portion is reduced to realize a reduction in cost. A fuel feed pump 1A for delivering fuel fed from a low-pressure pump to an injector at a high pressure, comprises a pump chamber 13 communicated with a fuel introduction passage 14 and a delivery passage 15, a plunger 3A being reciprocatingly driven upon abutting a cam 5 that is driven by the output of an engine, and a sleeve 7 for guiding the lateral surface of said plunger in the axial direction, wherein said plunger is formed of ceramic as a single structure, has a sliding portion 31 at one end surface thereof to abut said cam, and forms said pump chamber at the other end thereof.

3 Claims, 2 Drawing Sheets

FUEL FEED PUMP

BACKGROUND OF THE INVENTION

1. Field of the Invention

The present invention relates to a fuel feed pump for feeding high pressure fuel to fuel injectors used for in-cylinder fuel injection system. More particularly, the invention relates to a fuel feed pump having an improved structure for a piston (plunger) that is driven by a cam linked to an engine.

2. Prior Art

The fuel feed pump that feeds high pressure fuel to fuel injectors for direct injection system has heretofore employed a piston structure that is driven in the axial direction by contacting with a cam that is driven or rotated by the output of an engine.

In this type of fuel feed pump, the durability of the piston structure having a portion that slides on a cam, hereafter termed a sliding portion must be maintained. In the fuel feed pump disclosed in, for example, Japanese Patent App. Laid-open No. 10-82354, wear resistance is maintained by attaching a separate shoe to the end surface of the plunger that slides on the outer peripheral surface of the cam.

FIG. 2 is a sectional side view illustrating an essential portion of a conventional fuel feed pump, and shows a structure having a sliding portion which is separate from a plunger at the end of the plunger.

In FIG. 2, the fuel feed pump 1 has a plunger 3 in a casing 2 that serves as the upper main body, the plunger 3 being accommodated so as to be slidable in the vertical axial direction in FIG. 2.

A tappet 4 which is separate from the plunger 3 is integrally secured to an end of the plunger 3. The tappet 4 is made of a material such as a very hard metal having excellent wear resistance. A cam 5 which is rotated by the output of the engine abuts the end surface of the tappet 4.

The cam is linked to the drive shaft of the engine (not shown) and has multiple lobes 5*a* at equal intervals on the outer peripheral surface thereof in order to reciprocatingly drive the plunger 3 via the tappet 4.

The casing 2 includes a compression spring 6 for urging the plunger 3 in a direction in which it comes into pressing contact with the cam 5, a cylindrical sleeve 7 for guiding the lateral surfaces of the plunger 3 in the axial direction, and a housing 8 for accommodating the sleeve 7.

Further, a bracket 9 is integrally attached to the casing 2 to contain the housing 8 and the sleeve 7.

The end surface of the tappet 4 protrudes through an opening 9*a* of the bracket 9.

A holding member 10 in the shape of a flange is press fitted on to the periphery of the end portion of the housing 8, and an oil seal 11 made of rubber is slidably brought into contact with the plunger 3.

A heat insulator 12 is provided on the engine mount portion on the periphery of the bracket 9 to suppress the conduction of heat from the engine side (not shown) to the pump body (casing 2).

A pump chamber 13 is formed at an upper end of the plunger 3, and is communicated with a fuel (gasoline) introduction passage 14 and a delivery passage 15.

The introduction passage 14 and the delivery passage 15 are communicated with an introduction port and a delivery port (not shown) formed in the casing 2.

The introduction passage 14 and the delivery passage 15 are provided with a valve structure for the pump chamber 13, in order to introduce and deliver fuel according to the reciprocating motion of the plunger 3.

The introduction port in the casing 2 receives fuel fed from a low-pressure pump (not shown), and the delivery port delivers the pressurized fuel to the injector (not shown) through a high-pressure conduit.

Ring-like seals are interposed at the joint surfaces of each member in order to prevent fuel leakage.

In the fuel feed pump 1 shown in FIG. 2, the plunger 3 and the tappet 4 are reciprocatingly driven by the cam 5 that moves or rotates in synchronism with a control stroke of each cylinder of the engine and opens and closes the introduction passage 14 and the delivery passage 15 to supply high pressure fuel into the injector.

In order to improve the resistance of the sleeve 7 against seizure (resistance against adhesion), the surface of the plunger 3 is made of, for example, a metal material which is heat-treated and then coated with CrN or NiP.

The plunger 3, therefore, is formed with a high degree of hardness on the surface of the sliding portion corresponding to the sleeve 7, and with small surface roughness (improved smoothness).

Further, the tappet 4 that slides with the cam 5 is machined separately from the plunger 3 that slides relative to the sleeve 7, and a surface treatment is performed on the portion that slides (sliding portion) on the cams so that it will not be damaged. The tappet 4 is assembled so as to be integral with the plunger 3 and is mounted in the casing 2.

According to the conventional fuel feed pump 1 described above, the piston portion that slides on the cam 5 has a tappet 4 which is separate from the plunger 3. Therefore, the plunger 3 and the tappet 4 must be separately machined and assembled. Moreover, the surfaces of the plunger 3 and the tappet 4 must be polished and coated, thus creating a problem in that with the increased number machining steps the costs cannot be decreased.

SUMMARY OF THE INVENTION

The present invention was accomplished in order to solve the above-mentioned problems, and an object thereof is to obtain a fuel feed pump having a plunger that is constructed as a single structure and that can be realized at a decreased cost owing to a decrease in the number of machining steps.

Another object of the present invention is to obtain a fuel feed pump having improved reliability by preventing a change in the clearance between the plunger and the sleeve due to changes in temperature.

According to the present invention, a fuel feed pump for delivering fuel fed from a low-pressure pump to an injector at high pressure, comprises:

- a pump chamber communicated with a fuel introduction passage and a delivery passage;
- a plunger reciprocatingly driven upon abutting a cam that is driven by the output of an engine; and
- a sleeve for guiding a lateral surface of said plunger in the axial direction;
- wherein said plunger is formed of ceramic as a single structure, has a sliding portion at one end surface thereof to abut said cam, and forms said pump chamber at the other end thereof.

The plunger in the fuel feed pump according to a preferred embodiment of the present invention is made of a material having a coefficient of thermal expansion close to that of the sleeve.

The sleeve in the fuel feed pump according to another preferred embodiment of the present invention is made of steel, and the plunger is made of zirconia.

DESCRIPTION OF THE PREFERRED EMBODIMENTS

Figure 1:
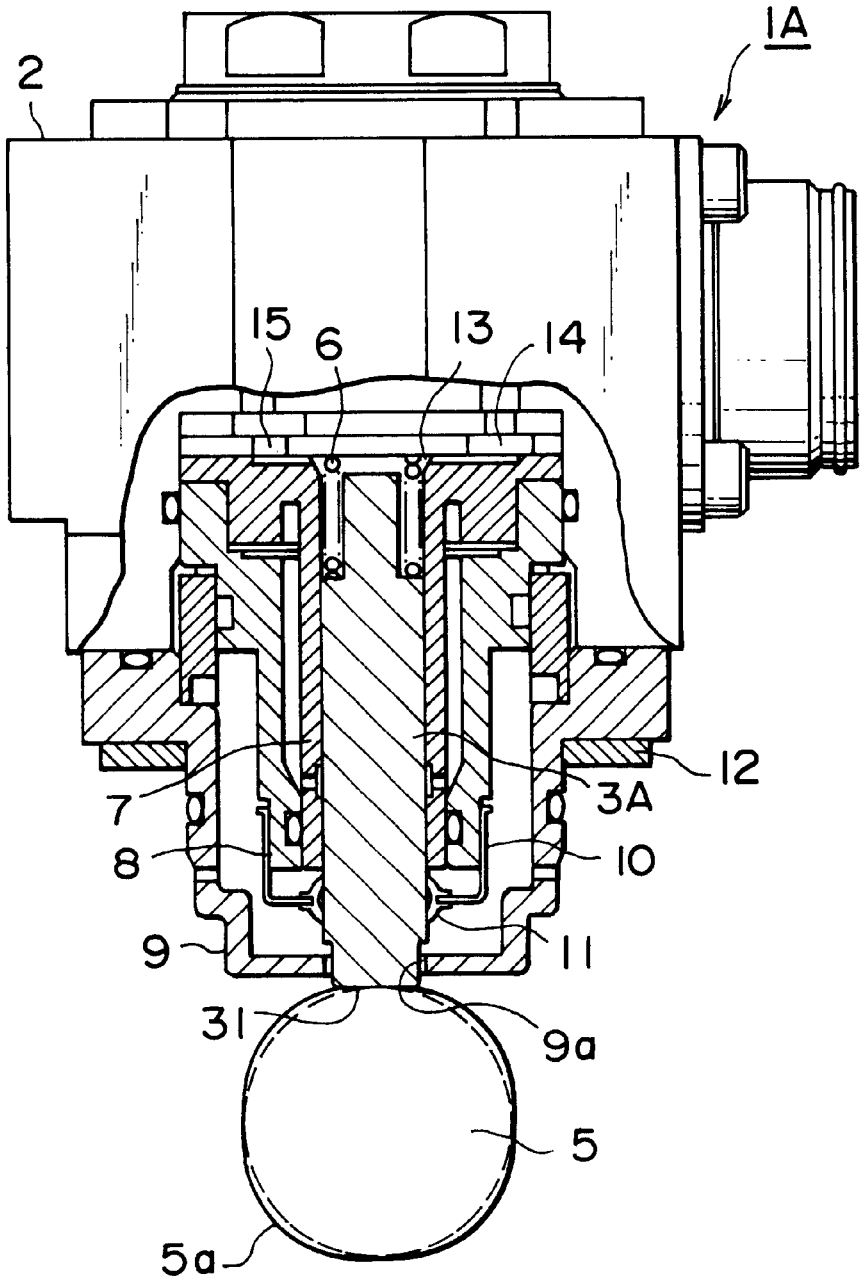
FIG. 1 is a sectional side view illustrating an essential portion of the embodiment 1 of the present invention.

Embodiment 1.

Embodiment 1 of the present invention will now be described with reference to the drawing.

Figure 2:
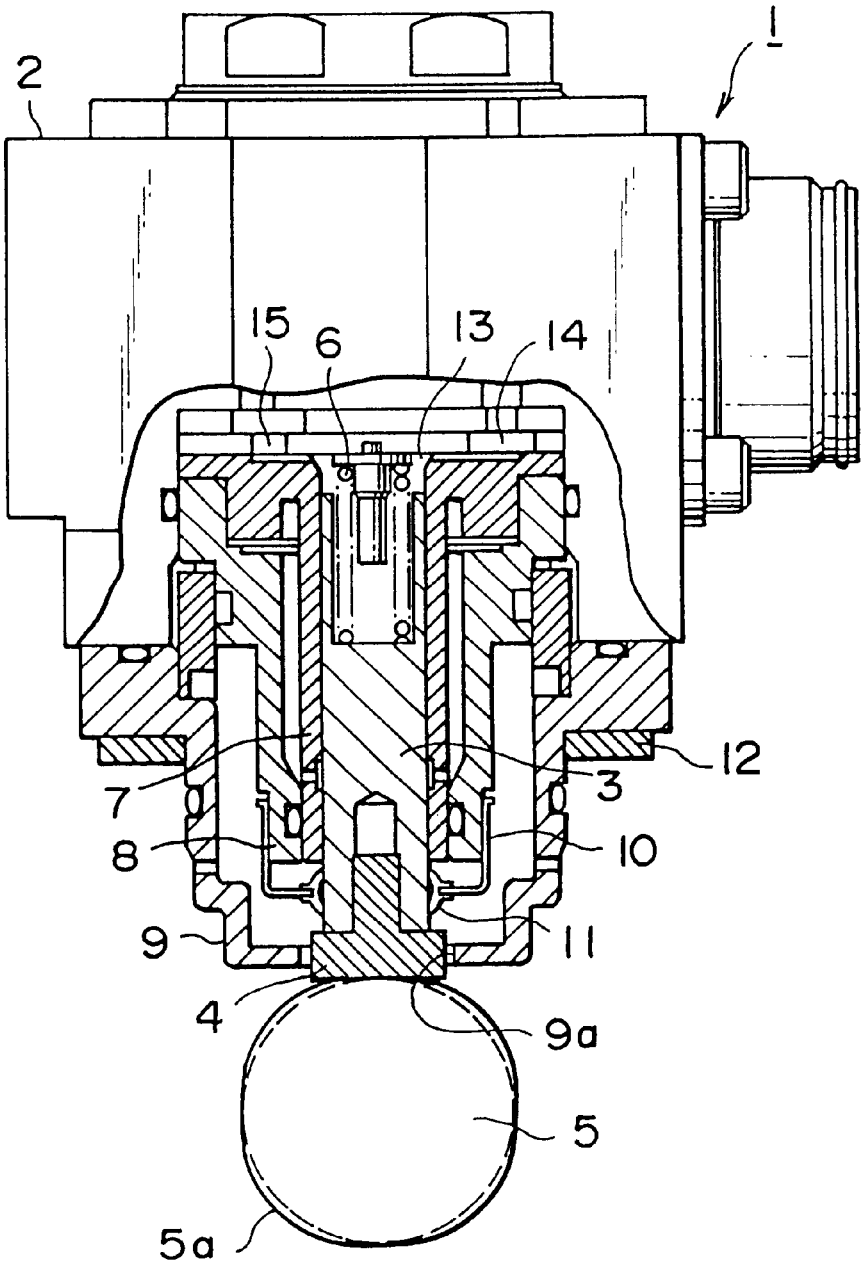
FIG. 2 PRIOR ART
FIG. 2 is a sectional side view illustrating an essential portion of a conventional fuel feed pump.

FIG. 1 is a sectional side view illustrating an essential portion of the fuel feed pump 1A according to embodiment 1 of the invention, wherein the same portions as those of the above-mentioned fuel feed pump (see FIG. 2) are denoted by the same reference numerals and their description is not repeated.

In FIG. 1, a plunger 3A is formed of ceramic as a single structure, and has a sliding portion 31 at one end surface to abut the cam 5 and a pump chamber formed at the other end thereof.

By using the ceramic plunger 3A having excellent wear and seizure resistance, wear of the plunger 3A is suppressed even when lubrication based on fuel becomes insufficient between the plunger 3A and the sleeve 7, and seizure (adhesion) is prevented from occurring between the plunger 3A and the sleeve 7.

Further, a sliding portion 31 which abuts the cam 5 is integrally formed at one end surface of the ceramic plunger 3A so as to function as a tappet 4 (see FIG. 2), thus making it possible to decrease the cost by decreasing the number of parts and the number of machining steps.

Moreover, in addition to the ceramic having sufficient hardness and smoothness, since it also has excellent workability for precise machining, no trouble is-encountered in forming the plunger 3A as a single structure.

Embodiment 2.

In the above-mentioned embodiment 1, the material of the plunger 3A was not concretely described. It is, however, preferable that the plunger 3A be made of a material having a coefficient of thermal expansion close to that of the sleeve 7.

That is, when the sleeve 7 is made of steel, zirconia is selected as a ceramic material for forming the plunger 3A.

By forming the plunger 3A from zirconia, the coefficient of thermal expansion $\alpha 3$ of the plunger 3A can be brought close to the coefficient of thermal expansion $\alpha 7$ ($=12\times10^{-6}/°$ C.) of the steel sleeve 7.

By using zirconia having a coefficient of thermal expansion $\alpha 3$ which is close to the coefficient of thermal expansion $\alpha 7$ of the steel sleeve 7, as the ceramic material for the plunger 3A, a change in the slide clearance (gap) between the plunger 3A and the sleeve 7 can be suppressed even when the peripheral temperature of the plunger 3A undergoes a change, and thus the reliability of the fuel feed pump 1A can be improved.

It goes without saying that the material of the plunger 3A is not limited to zirconia, but any material can be selected depending upon the material of the sleeve 7.

Though the present invention was described above by way of preferred embodiments, people skilled in the art will be able to easily understand that the invention can be suitably changed and modified within the technical scope of the invention. Therefore, the scope of patent rights is to be determined based on the claims and their equivalents.

What is claimed is:

1. A fuel feed pump for delivering fuel fed from a low-pressure pump to an injector at a high pressure, comprising:

a pump chamber communicated with a fuel introduction passage and a delivery passage;

a plunger being reciprocatingly driven upon abutting a cam that is driven by the output of an engine; and a sleeve for guiding a lateral surface of said plunger in the axial direction;

wherein said plunger is formed of ceramic as a single structure, has a ceramic sliding portion at one end surface thereof to abut said cam, and forms said pump chamber at the other end thereof.

2. A fuel feed pump according to claim 1, wherein said plunger is made of a material having a coefficient of thermal expansion close to that of said sleeve.

3. A fuel feed pump according to claim 2, wherein said sleeve is made of steel, and said plunger is made of zirconia.

* * * * *